US009243367B2

(12) United States Patent
Rekoske et al.

(10) Patent No.: US 9,243,367 B2
(45) Date of Patent: Jan. 26, 2016

(54) SOFT CREPED TISSUE

(71) Applicant: Kimberly-Clark Worldwide, Inc., Neenah, WI (US)

(72) Inventors: Michael John Rekoske, Appleton, WI (US); Dave Allen Soerens, Neenah, WI (US); Frank Gerald Druecke, Oshkosh, WI (US); Jeffrey James Timm, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 177 days.

(21) Appl. No.: 13/645,993

(22) Filed: Oct. 5, 2012

(65) Prior Publication Data

US 2014/0096924 A1 Apr. 10, 2014

(51) Int. Cl.
*D21H 27/00* (2006.01)
*D21H 27/40* (2006.01)

(52) U.S. Cl.
CPC ..... *D21H 27/002* (2013.01); *D21H 27/40* (2013.01)

(58) Field of Classification Search
CPC ..... D21H 27/00; D21H 27/30; D21H 19/10; D21H 19/12; D21H 19/72; D21H 19/74; D21H 27/002; D21H 27/40; B31F 1/126; B32B 5/22; Y10T 428/24446
USPC ..... 428/152
See application file for complete search history.

(56) References Cited

U.S. PATENT DOCUMENTS

| | | | | |
|---|---|---|---|---|
| 5,409,572 | A | 4/1995 | Kershaw et al. | |
| 2007/0137808 | A1 | 6/2007 | Lostocco et al. | |
| 2009/0056892 | A1* | 3/2009 | Rekoske et al. | 162/111 |
| 2010/0065234 | A1 | 3/2010 | Klerelid et al. | |
| 2010/0159200 | A1* | 6/2010 | Soerens et al. | 428/153 |
| 2012/0031576 | A1 | 2/2012 | Gane et al. | |
| 2013/0071655 | A1 | 3/2013 | Zwick et al. | |

FOREIGN PATENT DOCUMENTS

| | | | |
|---|---|---|---|
| EP | 0 399 522 | A2 | 11/1990 |

* cited by examiner

*Primary Examiner* — Maria Veronica Ewald
*Assistant Examiner* — Nancy Johnson
(74) *Attorney, Agent, or Firm* — Kimberly-Clark Worldwide, Inc.

(57) ABSTRACT

The present disclosure is directed to creped tissue webs, and products produced therefrom. The creped tissue webs and tissue products made therefrom are soft and strong, such as having a TS7 value less than about 8.0. Moreover, the tissue of the present disclosure also preferably has low TS750 values such as less than about 7.0. Further, while webs prepared according to the present disclosure have low TS7, and in certain embodiments low TS750 values, they are also strong enough to withstand use.

16 Claims, 3 Drawing Sheets

SOFT CREPED TISSUE

BACKGROUND

In the manufacture of paper products, such as facial tissues, bath tissues, napkins, wipes, paper towels, etc., it is often desired to optimize various properties of the products. For example, the products should have good bulk, a soft feel, and should have good strength. Unfortunately, however, when steps are taken to increase one property of the product, other characteristics of the product are often adversely affected.

For instance, it is very difficult to produce a high strength paper product that is also soft. In particular, strength is typically increased by the addition of certain strength or bonding agents to the product. Although the strength of the paper product is increased, various methods are often used to soften the product that can result in decreased fiber bonding. For example, chemical debonders can be utilized to reduce fiber bonding and thereby increase softness. Moreover, mechanical forces, such as creping or calendering, can also be utilized to increase softness.

However, reducing fiber bonding with a chemical debonder or through mechanical forces can adversely affect the strength of the paper product. For example, hydrogen bonds between adjacent fibers can be broken by such chemical debonders, as well as by mechanical forces of a papermaking process. Consequently, such debonding results in loosely bound fibers that extend from the surface of the tissue product. During processing and/or use, these loosely bound fibers can be freed from the tissue product, thereby creating lint, which is defined as individual airborne fibers and fiber fragments. Moreover, papermaking processes may also create zones of fibers that are poorly bound to each other but not to adjacent zones of fibers. As a result, during use, certain shear forces can liberate the weakly bound zones from the remaining fibers, thereby resulting in slough, i.e., bundles or pills on surfaces, such as skin or fabric. As such, the use of such debonders can often result in a much weaker paper product during use that exhibits substantial amounts of lint and slough. As such, a need currently exists for a paper product that is soft, yet strong enough to prevent sloughing. Moreover, there is a need for a product that can be produced without the excessive use of debonders.

SUMMARY

Typically to achieve a soft tissue the strength of the web is decreased and short, low coarseness fibers, treated with a chemical debonder, are disposed on the skin-contacting surface of the web. The softness levels achievable using such techniques, however, are limited by the user's desire to have a tissue that is strong enough to withstand use and to avoid large amounts of fibers sloughing from the tissue surface in-use. The present invention, however, overcomes these limitations to yield novel tissue webs that have improved softness, while maintaining sufficient strength.

Accordingly, in one aspect the disclosure provides a creped tissue web having a TS7 value less than about 8.0 dB $V^2$ rms.

In other aspects the disclosure provides a creped tissue web having a TS7 value less than about 8.0 dB $V^2$ rms and a TS750 value less than about 7.0 dB $V^2$ rms.

In yet other aspects the disclosure provides a creped tissue product comprising one or more plies, the tissue product having a geometric mean tensile (GMT) from greater than about 600 g/3" and a TS7 value of less than about 8 dB $V^2$ rms.

In still other aspects the disclosure provides a creped tissue web having a GMT from about 300 about 1000 g/3" and a TS7 value of less than about 8.0 dB $V^2$ rms.

In other aspects the disclosure provides a creped tissue web having a basis weight of greater than about 10 gsm and a TS7 value from about 4.0 to about 8.0 dB $V^2$ rms.

In still other aspects the present disclosure provides a multi-ply tissue product comprising two multi-layered creped tissue webs, the tissue webs having three superposed layers, an inner layer consisting essentially of softwood fibers and two outer layers consisting essentially of hardwood fibers, the inner layer being located between the two outer layers, wherein each web has a GMT greater than about 300 g/3" and a TS7 value of less than about 8.0 dB $V^2$ rms.

These and other features and aspects of the present disclosure are discussed in greater detail below.

DEFINITIONS

As used herein, the terms "TS7" and "TS7 value" refer to an output of an EMTEC Tissue Softness Analyzer ("TSA") (Emtec Electronic GmbH, Leipzig, Germany) as described in the Test Methods section. The units of the TS7 value are dB $V^2$ rms, however, TS7 values are often referred to herein without reference to units.

As used herein, the terms "TS750" and "TS750 value" refer to another output of the TSA as described in the Test Methods section. The units of the TS750 value are dB $V^2$ rms, however, TS750 values are often referred to herein without reference to units.

As used herein, the term "geometric mean tensile" (GMT) refers to the square root of the product of the machine direction tensile and the cross-machine direction tensile of the web, which are determined as described in the Test Method section.

As used herein, the term "tissue product" refers to products made from tissue webs and includes, bath tissues, facial tissues, paper towels, industrial wipers, foodservice wipers, napkins, medical pads, and other similar products.

As used herein, the terms "tissue web" and "tissue sheet" refer to a fibrous sheet material suitable for use as a tissue product.

As used herein, the term "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second. Caliper may be expressed in mils (0.001 inches) or microns.

As used herein the term "basis weight" generally refers to the conditioned weight per unit area of a tissue and is generally expressed as grams per square meter (gsm). Basis weight is measured herein using TAPPI test method T-220.

DETAILED DESCRIPTION

Figure 1:
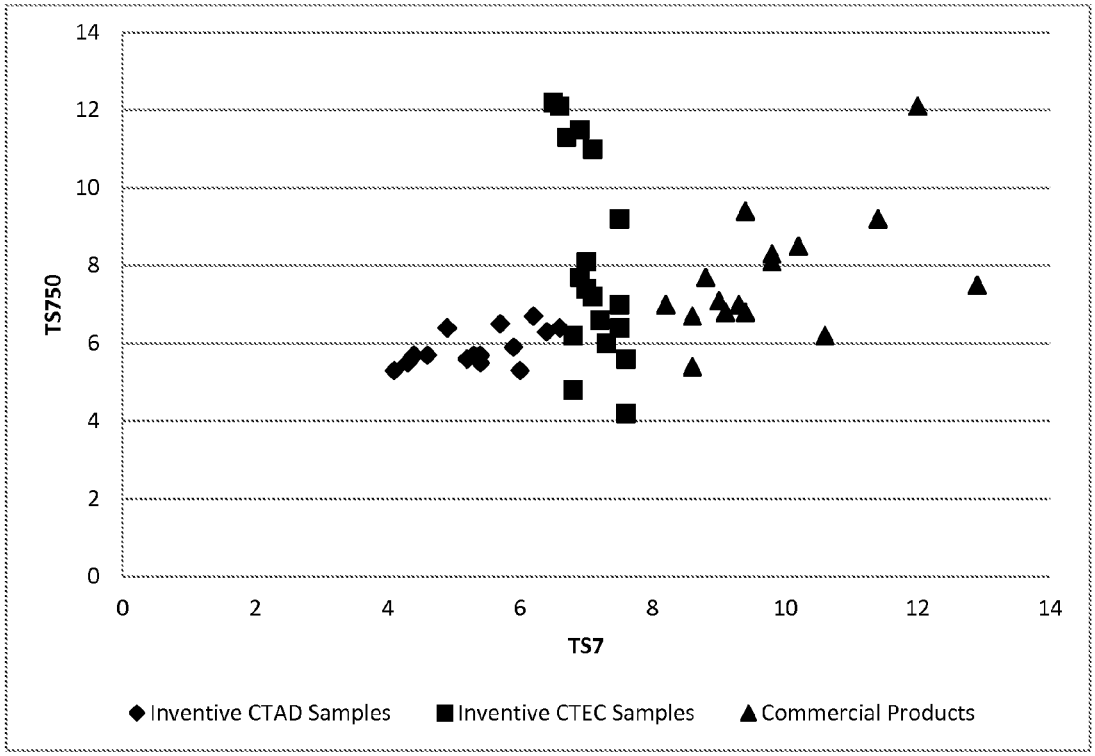
FIG. 1 is a plot of TS7 values (x-axis) versus TS750 values (y-axis) for various inventive and commercial tissue samples.
Figure 2:
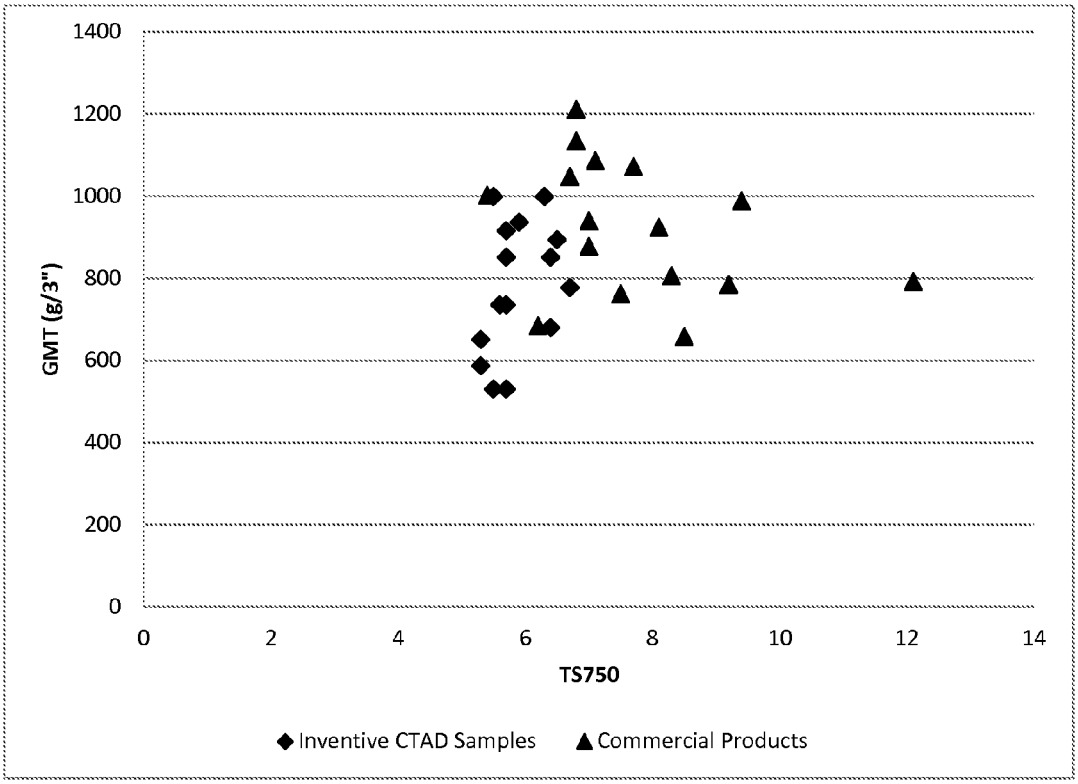
FIG. 2 is a plot of TS750 values (x-axis) versus GMT (y-axis) for various inventive and commercial tissue samples.
Figure 3:
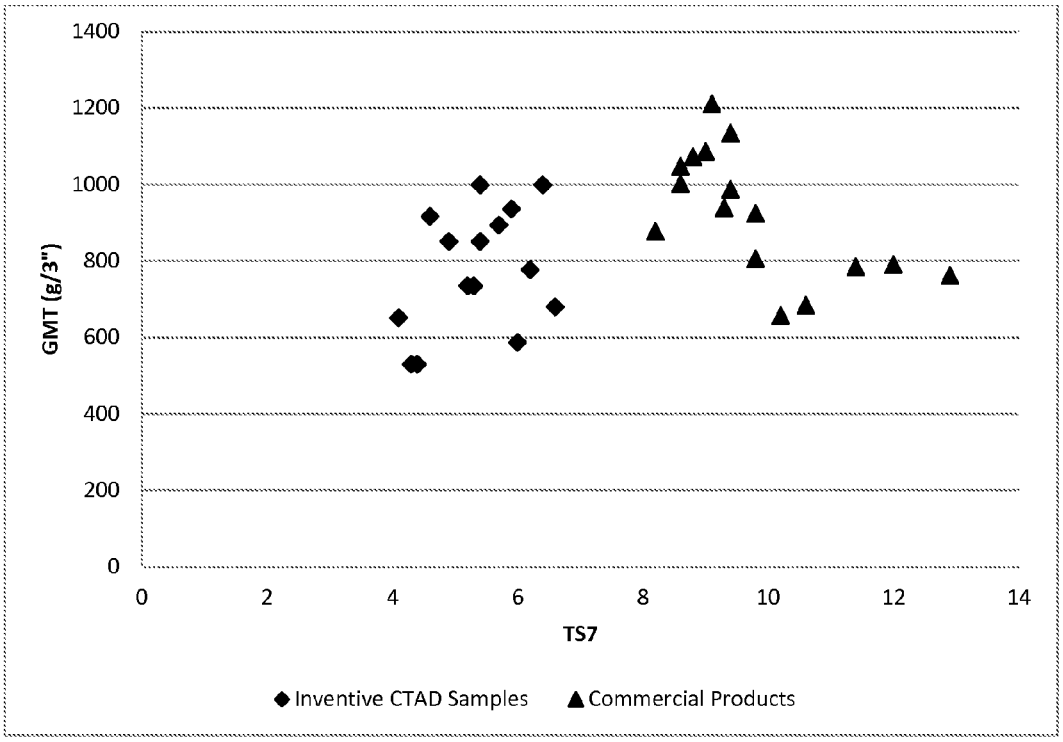
FIG. 3 is a plot of TS7 values (x-axis) versus GMT (y-axis) for various inventive and commercial tissue samples.

In general, the present disclosure is directed to creped tissue webs, and products produced therefrom. The creped tissue webs and tissue products made therefrom are soft and strong and as such generally have TS7 values less than about 8.0 and a geometric mean tensile ("GMT") greater than about 300 g/3" for single-ply tissue webs and greater than about 500 g/3" for multi-ply tissue products. In particularly preferred embodiments tissue produced according to the present disclosure also has a low TS750 value such as less than about 7.0. Further, while tissue prepared according to the present disclosure has low TS7, and in certain embodiments low TS750, it is also strong enough to withstand use. As such single-ply tissue webs prepared as disclosed herein preferably have a GMT greater than about 300 g/3", such as from about 400 to about 500 g/3".

Tissue webs and products having low TS7 and/or TS750 values may be prepared using a number of creped tissue making processes, such as conventional wet pressed (also referred to herein as "CTEC") and through-air dried (also referred to herein as "TAD"). Further, products having low TS7 and/or TS750 values may be prepared by post-treating the web by calendering or application of a topical additive such as a polysiloxane that makes a tissue product feel softer to the skin of a user. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight, branched or cyclic carbon chain containing from about 3 to about 8 carbon atoms. Some commercially available examples of polysiloxanes include Y-14128, Y-14344, Y-14461 and FTS-226 (commercially available from Momentive Performance Materials, Albany, N.Y.), and Dow Corning 8620, 2-8182, and 2-8194 (commercially available from Dow Corning Corporation, Midland, Mich.).

When used, polysiloxanes may be combined with water and surfactants, such as nonionic ethoxylated alcohols, to form emulsions and applied to tissue webs. Since the process of the present invention can accommodate higher viscosities, however, the polysiloxanes can be added directly to a tissue web without having to be combined with water, a surfactant or any other dilution agent. For example, a neat composition, such as a neat polysiloxane can be applied to a web in accordance with the present disclosure.

Additionally, tissue webs and products having low TS7 and/or TS750 values may be prepared by applying a creping composition at high addition levels, such as greater than about 30 mg of solids per square meter of the creping surface, such as a Yankee Dryer. Still more preferably the creping composition is added to the creping surface at solids greater than about 50 mg/m$^2$, and even more preferably greater than about 100 mg/m$^2$, such as from about 50 to about 300 mg/m$^2$. The level of total solids add-on is preferably several times greater than traditional creping methods, which have typically employed add-on levels from about 2 to about 30 mg/m$^2$. Even at the increased add-on levels the present disclosure provides creping compositions that balance adhesion and release of the web from the Yankee Dryer, without the build-up of deposits of organic and/or inorganic components that can have a negative impact on creping efficiency.

When applied at high add-on levels to the Yankee Dryer, the creping compositions of the present disclosure develop proper coating equilibrium and a relatively constant Z-directional thickness of the coating on the dryer surface. When transferred to the web, the creping composition may form a continuous or a discontinuous film depending upon the additive composition and amount applied to the web. In other embodiments, the creping composition may be applied to a web such that the creping composition forms discrete treated areas on the surface of the web.

The thickness of the additive composition when present on the surface of a base sheet can vary depending upon the ingredients of the additive composition and the amount applied. In general, for instance, the thickness can vary from about 0.01 microns to about 10 microns. At higher add-on levels, for instance, the thickness may be from about 3 microns to about 8 microns. At lower add-on levels, however, the thickness may be from about 0.1 microns to about 1 micron, such as from about 0.3 microns to about 0.7 microns.

The area of the base sheet covered by the additive composition may vary from about 10 to about 100 percent of the surface area of one side of the base sheet. For instance, the additive composition may cover from about 20 to 100 percent of the surface area of the base sheet, such as from about 20 to about 90 percent, such as from about 20 to about 75 percent.

To achieve the desired creping efficiency and tissue product properties, tissue webs may be creped using a creping composition comprising at least one, and more preferably at least two, water-soluble polymers. For purposes herein, "water-soluble" means that the polymers dissolve completely in water to give a solution as opposed to a latex, dispersion, or suspension of undissolved particles.

In one embodiment the water-soluble polymer applied to the creping surface is an aqueous solution comprising a polyether, a polyamide, or a mixture of one or both with another water-soluble polymer. Suitable polyethers include (poly) ethylene oxide, (poly)propylene oxide, ethylene oxide/propylene oxide copolymers, (poly)tetra methylene oxide, poly vinyl methyl ether, and the like. Suitable polyamides include (poly)vinylpyrrolidone, (poly)ethyl oxazoline, (poly)amidoamine, (poly)acrylamide, polyethylene imine, and the like. Number average molecular weights for these components should be from about 10,000 to about 500,000.

Other water-soluble polymers which can be mixed with either of the water-soluble polymeric components used to form the creping composition include polyvinyl alcohol (PVOH), carboxymethylcellulose, hydroxypropyl cellulose, and the like.

In certain embodiments the creping composition may further comprise a polymeric component having an affinity for the fibers making up the web, such as a cationic polymer, and more specifically a cationic starch. As used herein the term "cationic starch" refers to a starch that has been chemically modified to impart a cationic constituent moiety. Suitable cationic polymers include cationic starches having a charge density of at least about 0.1 mEq/g, such as, for example, Redibond™ 2038 (Ingredion Incorporated, Westchester, Ill.) which has a charge density of about 0.22 mEq/g.

Particularly preferred cationic starches for use in the creping composition of the present disclosure are the tertiary aminoalkyl ethers and quaternary ammonium alkyl ethers, which include commercial cationic starches produced by Ingredion Incorporated, Westchester, Ill., under the trade names Redibond™ and Optipro™. Grades with cationic moieties only such as Redibond 5327™, Redibond 5330A™, and Optipro™ 650 are suitable, as are grades with additional anionic functionality such as Redibond 2038™.

The cationic component can be present in the creping composition in any operative amount and will vary based on the chemical component selected, as well as on the end properties that are desired. For example, in the exemplary case of Redibond 2038™, the cationic component can be present in the creping composition in an amount of about 10 to 90 wt %, such as 20 to 80 wt % or 30 to 70 wt % based on the total weight of the creping composition, to provide improved benefits.

Other suitable cationic components include cationic debonders and/or softeners. Cationic debonders and softeners are known in the papermaking art and are generally used as wet-end additives to enhance bulk and softness. Debonders are generally hydrophobic molecules that have a cationic charge. As wet end additives debonders function typically by disrupting inter-fiber bonding thereby increasing bulk and increasing perceived softness, but at the expense of a decrease in sheet strength. Softening agents are similar in chemistry to debonders, i.e., they are generally hydrophobic molecules that have a cationic charge. Examples of debonders and softening chemistries may include the simple quaternary ammonium salts having the general formula:

$$(R^{1'})_{4-b}—N^{+}—(R^{1''})_{b}X^{-}$$

wherein $R^{1'}$ is a $C_{1-6}$ alkyl group, $R^{1''}$ is a $C_{14-22}$ alkyl group, b is an integer from 1 to 3 and $X^{-}$ is any suitable counterion. Other similar compounds may include the monoester, diester, monoamide, and diamide derivatives of the simple quaternary ammonium salts. A number of variations on these quaternary ammonium compounds should be considered to fall within the scope of the present invention. Additional softening compositions include cationic oleyl imidazoline materials such as methyl-1-oleyl amidoethyl-2-oleyl imidazo linium methylsulfate commercially available as Mackernium CD-183 (McIntyre Ltd., University Park, Ill.) and Prosoft TQ-1003 (Ashland, Inc., Covington, Ky.).

In still other embodiments the creping composition comprises a water soluble cationic polyamide-epihalohydrin, which is the reaction product of an epihalohydrin and a polyamide containing secondary amine groups or tertiary amine groups. Commercially available preferred polyamide-epihalohydrins are sold under the trade names including Kymene™, Crepetrol™ and Rezosol™ (Ashland Water Technologies, Wilmington, Del.).

Compared to commercially available tissue, tissue products prepared according to the present disclosure generally have low TS7 values, such as less than about 8.0 and more preferably less than about 7.5, even more preferably less than about 7.0, and most preferably less than about 6.5, such as from about 4.0 to about 7.0. In other embodiments tissue products have low TS750 values, such as less than about 7.0, more preferably less than about 6.0, and still more preferably less than about 5.5, such as from about 4.0 to about 6.0. In other embodiments tissue products may have both a low TS7 value, such as less than about 8.0 and a low TS750 value, such as less than about 7.0, all while maintaining sufficient strength to withstand use, such as a GMT greater than about 400 g/3", such as from about 400 to about 1000 g/3".

Without wishing to be bound by theory, tissue webs and products produced therefrom are believed to achieve low TS7 and/or low TS750 values through the beneficial combination of improved tissue making methods and materials, such as, for example, high levels of low coarseness hardwood fibers, the addition of novel creping compositions at high add-on levels, the introduction of fine crepe structure to the creped tissue web and the post-treatment of the tissue web with calendering and/or topical treatment.

To illustrate the improvement over commercially available tissue, the table below compares inventive samples prepared as described herein with commercially available tissue.

TABLE 1

| | BW (gsm) | TS7 | TS750 | E (mm/N) | D (mm/N) |
|---|---|---|---|---|---|
| Kleenex ® Ultra Facial Tissue | 25.7 | 9.4 | 6.8 | 3.58 | 3.67 |
| Kleenex ® Lotion Facial Tissue | 27.9 | 9.0 | 7.1 | 3.54 | 3.69 |
| Kleenex ® Anti-Viral Facial Tissue | 45.5 | 9.1 | 6.8 | 3.09 | 3.27 |
| Puffs Ultra Strong and Soft ® Facial Tissue | 36.9 | 8.8 | 7.7 | 3.05 | 3.18 |
| Puffs Plus ® Facial Tissue | 46.4 | 8.6 | 5.4 | 3.18 | 3.33 |
| Puffs Plus Lotion ® Facial Tissue | 46.5 | 9.8 | 8.1 | 3.28 | 3.44 |
| Von's Ultra ® Facial Tissue | 44.8 | 8.6 | 6.7 | 2.82 | 2.98 |
| Kroger Nice & Soft with Lotion | 46.2 | 9.3 | 7.0 | 3.11 | 3.32 |
| ShopRite Ultra Facial Tissue | 46.6 | 9.4 | 9.4 | 3.08 | 3.27 |
| Up&Up ™ Ultra Facial Tissue | 46.4 | 8.2 | 7.0 | 3.45 | 3.65 |
| Up&Up ™ Facial Tissue | 31.2 | 11.4 | 9.2 | 3.22 | 3.32 |
| Scotties ® Facial Tissue | 31.2 | 12.0 | 12.1 | 2.84 | 2.92 |
| Publix ® Facial Tissue | 32.2 | 12.9 | 7.5 | 3.38 | 3.47 |
| Walgreens ® Facial Tissue | 27.8 | 10.2 | 8.5 | 3.23 | 3.36 |
| Puffs ® Facial Tissue | 29.6 | 10.6 | 6.2 | 3.43 | 3.53 |
| Kleenex ® Facial Tissue | 28.4 | 9.8 | 8.3 | 3.27 | 3.40 |
| Inventive CTEC Sample | 29.6 | 7.6 | 6.0 | 2.7 | 3.2 |
| Inventive CTAD Sample | 29.8 | 4.1 | 5.3 | 2.68 | 3.36 |

The basis weight of tissue webs made in accordance with the present disclosure can vary depending upon the final product. For example, the process may be used to produce bath tissues, facial tissues, paper towels, and the like. In general, the basis weight of such fibrous products may vary from about 5 grams per square meter (gsm) to about 110 gsm, such as from about 10 gsm to about 90 gsm. For bath tissue and facial tissues products, for instance, the basis weight of the product may range from about 10 gsm to about 40 gsm.

Likewise, tissue web basis weight may also vary, such as from about 5 gsm to about 50 gsm, more preferably from about 10 gsm to about 30 gsm and still more preferably from about 14 gsm to about 20 gsm.

In multiple-ply products, the basis weight of each web present in the product can also vary. In general, the total basis weight of a multiple ply product will generally be from about 10 gsm to about 100 gsm. Thus, the basis weight of each ply can be from about 10 gsm to about 60 gsm, such as from about 20 gsm to about 40 gsm.

Tissue webs and products produced according to the present disclosure also have good bulk characteristics. For instance, bulk may vary from about 4 to about 15 $cm^3/g$, such as from about 5 to about 12 $cm^3/g$ or from about 6 to about 10 $cm^3/g$.

In addition to having good bulk, tissue webs and products prepared according to the present disclosure have improved softness and surface smoothness. For example, tissue webs prepared according to the present disclosure have TS7 values less than about 8.0, such as from about 5.0 to about 7.0 and in certain embodiments a TS750 value less than about 7.0, such as from about 4.0 to about 6.0. In a particularly preferred embodiment the present disclosure provides a tissue product comprising at least one creped tissue web having a basis weight of at least about 12 gsm, a GMT of at least about 300 g/3" and a TS7 value from about 5.0 to about 8.0.

Moreover, the low TS7 and/or TS750 values are achieved at relatively modest geometric mean tensile strengths. For example, tissue products prepared according to the present disclosure have geometric mean tensile strengths of less than about 1000 g/3", and more preferably less than about 900 g/3", such as from about 400 to about 1000 g/3".

In general, any suitable tissue web may be treated in accordance with the present disclosure. The tissue webs may then be converted into various tissue products, such as bath tissue, facial tissue, paper towels, napkins, and the like. Tissue products made according to the present disclosure may include single-ply or multiple-ply tissue products. For instance, in some aspects, the product may include two plies, three plies, or more.

Fibers suitable for making tissue webs comprise any natural or synthetic fibers including both nonwoody fibers and woody or pulp fibers. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. Nos. 4,793,898, 4,594,130, and 3,585,104. Useful fibers can also be produced by anthraquinone pulping, exemplified by U.S. Pat. No. 5,595,628.

Chemically treated natural cellulosic fibers can be used, for example, mercerized pulps, chemically stiffened or crosslinked fibers, or sulfonated fibers. For good mechanical properties in using web forming fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable web forming fibers can also include recycled fibers, virgin fibers, or mixes thereof.

In general, any process capable of forming a web can also be utilized in the present disclosure. For example, a web forming process of the present disclosure can utilize creping, wet creping, double creping, recreping, double recreping, embossing, wet pressing, air pressing, through-air drying, hydroentangling, creped through-air drying, co-forming, air-laying, as well as other processes known in the art. For hydroentangled material, the percentage of pulp is about 70 to 85 percent and the balance of fiber is synthetic.

Also suitable for articles of the present disclosure are fibrous sheets that are pattern densified or imprinted, such as the fibrous sheets disclosed in any of the following U.S. Pat. Nos. 4,514,345, 4,528,239, 5,098,522, 5,260,171, and 5,624,790, the disclosures of which are incorporated herein by reference to the extent they are non-contradictory herewith. Such imprinted fibrous sheets may have a network of densified regions that have been imprinted against a drum dryer by an imprinting fabric, and regions that are relatively less densified (e.g., "domes" in the fibrous sheet) corresponding to deflection conduits in the imprinting fabric, wherein the fibrous sheet superposed over the deflection conduits was deflected by an air pressure differential across the deflection conduit to form a lower-density pillow-like region or dome in the fibrous sheet.

Further, while webs having desired softness and strength may be produced without the use of chemical debonders to reduce the amount of fiber-fiber bonding within the web, in certain embodiments the fiber furnish used to form the base web may be treated with a chemical debonding agent. The debonding agent can be added to the fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone, quaternary salt and unsaturated fatty alkyl amine salts. Other suitable debonding agents are disclosed in U.S. Pat. No. 5,529,665, which is incorporated herein by reference in a manner consistent herewith.

While the creped webs of the present disclosure achieve low TS7 values and/or TS750 values without post treatment, the webs may, in certain embodiments, be post treated to provide additional benefits. The types of chemicals that may be added to the web may include topical additive such as a polysiloxane that makes a tissue product feel softer to the skin of a user. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. Other suitable additives may include compositions that supply skin health benefits such as mineral oil, aloe extract, vitamin-E, silicone, lotions in general, and the like. Such chemicals may be added at any point in the web forming process.

Tissue webs that may be treated in accordance with the present disclosure may include a single homogenous layer of fibers or may include a stratified or layered construction. For instance, the tissue web ply may include two or three layers of fibers. Each layer may have a different fiber composition. For example a three-layered headbox generally includes an upper head box wall and a lower head box wall. Headbox further includes a first divider and a second divider, which separate three fiber stock layers.

Each of the fiber layers comprises a dilute aqueous suspension of papermaking fibers. The particular fibers contained in each layer generally depend upon the product being formed and the desired results. For instance, the fiber composition of each layer may vary depending upon whether a bath tissue product, facial tissue product or paper towel is being produced. In one aspect, for instance, the middle layer contains southern softwood kraft fibers either alone or in combination with other fibers such as high yield fibers. Outer layers, on the other hand, contain softwood fibers, such as northern softwood kraft. In an alternative aspect, the middle layer may contain softwood fibers for strength, while the outer layers may comprise hardwood fibers, such as eucalyptus fibers.

In general, any process capable of forming a base sheet may be utilized in the present disclosure. For example, an endless traveling forming fabric, suitably supported and driven by rolls, receives the layered papermaking stock issuing from the headbox. Once retained on the fabric, the layered fiber suspension passes water through the fabric. Water removal is achieved by combinations of gravity, centrifugal force and vacuum suction depending on the forming configuration. Forming multi-layered paper webs is also described and disclosed in U.S. Pat. No. 5,129,988, which is incorporated herein by reference in a manner that is consistent herewith.

Preferably the formed web is dried by transfer to the surface of a rotatable heated dryer drum, such as a Yankee dryer. In accordance with the present disclosure, the creping composition may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade.

Creping the web, as it is formed, further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In addition to applying the creping composition during formation of the tissue web, the creping composition may also be used in post-forming processes. For example, in one aspect, the creping composition may be used during a print-creping process. Specifically, once topically applied to a tissue web, the creping composition has been found well-suited to adhering the tissue web to a creping surface, such as in a print-creping operation.

Tissue webs made according to the present disclosure can be incorporated into multiple-ply products. For instance, in one aspect, a tissue web made according to the present disclosure can be attached to one or more other tissue webs for forming a wiping product having desired characteristics. The other webs laminated to the tissue web of the present disclosure can be, for instance, a wet-creped web, a calendered web, an embossed web, a through-air dried web, a creped through-air dried web, an uncreped through-air dried web, an airlaid web, and the like.

In certain embodiments, when incorporating a tissue web made according to the present disclosure into a multiple-ply product, it may be desirable to only apply the creping composition to one side of the tissue web and to thereafter crepe the treated side of the web. The creped side of the web is then used to form an exterior surface of a multiple-ply product. The untreated and uncreped side of the web, on the other hand, is attached by any suitable means to one or more plies.

TEST METHODS

TS7 and TS750 Values

TS7 and TS750 values were measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against sample with a load of 100 mN and the rotational speed of the blades is 2 revolutions per second.

To measure TS7 and TS750 values two different frequency analyses are performed. The first frequency analysis is performed in the range of approximately 200 Hz to 1000 Hz, with the amplitude of the peak occurring at 750 Hz being recorded as the TS750 value. The TS750 value represents the surface smoothness of the sample. A high amplitude peak correlates to a rougher surface. A second frequency analysis is performed in the range from 1 to 10 kHZ, with the amplitude of the peak occurring at 7 kHz being recorded as the TS7 value. The TS7 value represents the softness of sample. A lower amplitude correlates to a softer sample. Both TS750 and TS7 values have the units dB $V^2$ rms.

To measure the stiffness properties of the test sample, the rotor is initially loaded against the sample to a load of 100 mN. Then, the rotor is gradually loaded further until the load reaches 600 mN. As the sample is loaded the instrument records sample displacement (μm) versus load (mN) and outputs a curve over the range of 100 to 600 mN. The modulus value "E" is reported as the slope of the displacement versus loading curve for this first loading cycle, with units of mm displacement/N of loading force. After the first loading cycle from 100 to 600 mN is completed, the instrument reduces the load back to 100 mN and then increases the load again to 600 mN for a second loading cycle. The slope of the displacement versus loading curve from the second loading cycle is called the "D" modulus value.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Tensile

Samples for tensile strength testing are prepared by cutting a 3 inches (76.2 mm)×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches (50.8±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.04 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

For multiple-ply products tensile testing is done on the number of plies expected in the finished product. For example, 2-ply products are tested two plies at one time and the recorded MD and CD tensile strengths are the strengths of both plies.

EXAMPLES

Example 1

Soft Creped Wet Pressed Tissue

Samples were made using a conventional wet pressed tissue-making process on a pilot scale tissue machine. Initially, northern softwood kraft (NSWK) pulp (Pictou Harmony Pulp, Northern Pulp, Nova Scotia, Canada) was dispersed in a pulper for 30 minutes at about 1.6 percent consistency at about 100° F. The NSWK pulp was refined in a batch refiner for about 4 minutes to a Canadian Standard Freeness (CSF) value of about 500 ml. The NSWK pulp was then transferred to a dump chest and subsequently diluted with water to approximately 0.6 percent consistency. Softwood fibers were then pumped to a machine chest where they were further diluted with water to a consistency of about 0.3 percent and mixed with 2 kg/MT of Kymene® 920A on a dry-solids basis (Ashland Water Technologies, Wilmington, Del.) prior to the headbox. The softwood fibers were added to the middle layer in the 3-layer tissue structure. The NSWK content contributed approximately 10 to 20 percent of the final sheet weight. The specific layer splits (dryer layer/middle layer/felt layer) are as set forth in Table 2.

Eucalyptus hardwood kraft (EHWK) pulp (Fibria Veracel pulp, Fibria, Sao Paulo, Brazil) was dispersed in a pulper for 30 minutes at about 1.6 percent consistency at about 100° F. The EHWK pulp was then transferred to a dump chest and diluted to about 0.6 percent consistency. The EHWK pulp was then pumped to a machine chest where they were further diluted with water to a consistency of about 0.15 percent and mixed with 2 kg/MT of Kymene® 920A. These fibers were added to the dryer and felt layers of the 3-layer sheet structure and contributed approximately 80 to 90 percent of the final sheet weight. The specific layer splits (dryer layer/middle layer/felt layer) are as set forth in Table 2.

Debonder (ProSoft™ TQ-1003, Ashland, Inc., Covington, Ky.) was added to the machine chest supplying EHWK pulp to the dryer side of the three layered tissue structure. The amount of debonder added varied from 4 pounds per ton of fiber to 12 pounds of debonder per ton of EHWK pulp, depending on the sample (see Table 2 for details).

The pulp fibers from the machine chests were pumped to the headbox at a consistency of about 0.02 percent. Pulp fibers from each machine chest were sent through separate manifolds in the headbox to create a 3-layered tissue structure. The fibers were deposited onto a TissueForm V forming fabric (Voith Paper Fabrics, Wilson, N.C.) in an inclined fourdrenier type of former.

The wet sheet from the forming fabric, at about 10 to 20 percent consistency, was vacuum dewatered and then transferred to a Superfine Duramesh press felt (Albany International Corp., Rochester, N.H.). The wet tissue sheet, supported by the press felt, was passed through the nip of a pressure roll, in order to partially dewater the sheet to a consistency of about 40 percent. The wet sheet was then adhered the Yankee dryer by spraying the creping composition onto the dryer surface using a spray boom situated underneath the dryer.

TABLE 2

| Sample | Debonder Addition (lb/MT) | Layer Splits (% HW/% SW/% HW) |
|---|---|---|
| 1 | 0 | 50/20/30 |
| 2 | 4 | 50/20/30 |
| 3 | 0 | 50/20/30 |
| 4 | 0 | 50/20/30 |
| 5 | 4 | 50/20/30 |
| 6 | 6 | 50/20/30 |
| 7 | 12 | 50/20/30 |
| 8 | 0 | 60/10/30 |
| 9 | 8 | 60/10/30 |
| 10 | 0 | 60/10/30 |
| 11 | 12 | 60/10/30 |
| 12 | 12 | 60/10/30 |

The creping compositions generally comprised a mixture of PerForm® PC 1279 (Ashland, Inc., Covington, Ky.), ProSoft™ TQ-1003 (Ashland, Inc., Covington, Ky.) and Redibond® 2038A (Ingredion Incorporated, Westchester, Ill.) or a mixture of poly(ethylene oxide) (commercially available as Polyox™ N80 from Dow Chemical, Midland, Mich.) and polyvinyl alcohol (Celvol 523 from Celanese, Houston Tex.). The creping compositions used to produce each of the samples is detailed in Table 3.

Creping compositions were prepared by dissolution of the solid polymers into water followed by stirring until the solution was homogeneous. Individual polymers were diluted depending on the desired spray coverage on the Yankee dryer. Alternatively, flow rates of the polymer solutions were varied to provide the desired amount of solids to the base web. The sheet was dried to about 98 to 99 percent consistency as it traveled on the Yankee dryer and to the creping blade. The Yankee dryer was heated with 30 to 35 psi of steam pressure to dry the sheet to a target sheet temperature of 240° F. before the creping blade. The Yankee dryer was traveling at about 60 FPM, unless otherwise noted. The creping blade, an 80-Proto-HY02 Durablade® (BTG, Eclépens, Switzerland) with a 10 to 15 degree grind angle, was loaded at a pressure of 30 psig. The creping blade subsequently scraped the tissue sheet off of the Yankee dryer. The creped tissue base sheet was then wound onto a core traveling at about 47 to about 52 FPM into soft rolls for converting. The basis weight of the resulting tissue was about 14 gsm and the GMT ranged from about 300 to about 450 g/3".

The soft rolls were then either converted directly to tissue product by rewinding and plying so that both creped sides were on the outside of a 2-ply tissue product, or subject to post treatment. In the event that soft rolls were post treated, they were either calendered or treated with silicone (see Tables 3 and 4 for details). The calendering was between two steel rolls with a nip loading of 50 psi. Silicone treatment was completed by applying 1 percent (by dry weight) of Momentive Y-14868 silicone emulsion (commercially available from Momentive Performance Materials, Albany, N.Y.) using rotogravure printing on the outside surface of each of the two plies.

TABLE 3

| Sample | Creping Composition Component 1 (wt %) | Component 2 (wt %) | Component 3 (wt %) | Creping composition Add-on (mg/m$^2$) | Post Treatment |
|---|---|---|---|---|---|
| 1C | Redibond 2038A (65%) | TQ-1003 (35%) | — | 300 | Calendered |
| 1S | Redibond 2038A (65%) | TQ-1003 (35%) | — | 300 | Silicone |
| 2C | Redibond 2038A (65%) | TQ-1003 (35%) | — | 300 | Calendered |
| 2S | Redibond 2038A (65%) | TQ-1003 (35%) | — | 300 | Silicone |
| 3S | Redibond 2038A (75%) | TQ-1003 (25%) | — | 300 | Silicone |
| 4S | Redibond 2038A (75%) | TQ-1003 (25%) | — | 300 | Silicone |
| 5S | PVOH (80%) | Polyox (20%) | — | 300 | Silicone |
| 6S | PVOH (80%) | Polyox (20%) | — | 300 | Silicone |
| 7S | PVOH (80%) | Polyox (20%) | — | 300 | Silicone |
| 8S | PVOH (90%) | Polyox (10%) | — | 300 | Silicone |
| 9C | Redibond (30%) | PC1279 (40%) | TQ-1003 (30%) | 300 | Calendered |
| 9S | Redibond (30%) | PC1279 (40%) | TQ-1003 (30%) | 300 | Silicone |
| 10C | Redibond (40%) | PC1279 (40%) | TQ-1003 (20%) | 300 | Calendered |
| 10S | Redibond (40%) | PC1279 (40%) | TQ-1003 (20%) | 300 | Silicone |
| 11C | Redibond (40%) | PC1279 (40%) | TQ-1003 (20%) | 300 | Calendered |
| 11 | Redibond (40%) | PC1279 (40%) | TQ-1003 (20%) | 300 | — |
| 12 | Redibond (40%) | PC1279 (40%) | TQ-1003 (20%) | 300 | — |
| 12S | Redibond (40%) | PC1279 (40%) | TQ-1003 (20%) | 300 | Silicone |

TABLE 4

| Sample | TS7 | TS750 | E (mm/N) | D (mm/N) | Single Sheet Caliper (μm) | 2-ply BW (gsm) | Bulk (cm$^3$/g) |
|---|---|---|---|---|---|---|---|
| 1C | 7.2 | 6.6 | 3.0 | 3.8 | 143 | 26.9 | 5.32 |
| 1S | 7.0 | 7.4 | 3.1 | 3.9 | 132 | 27.3 | 4.83 |
| 2C | 7.1 | 7.2 | 3.0 | 3.8 | 134 | 26.5 | 5.05 |
| 2S | 6.9 | 7.7 | 3.0 | 3.9 | 138 | 27.0 | 5.10 |
| 3S | 7.5 | 7.0 | 3.0 | 3.7 | 143 | 27.5 | 5.21 |
| 4S | 7.5 | 6.4 | 2.9 | 3.5 | 133 | 27.2 | 4.88 |
| 5S | 7.3 | 6.0 | 2.7 | 3.2 | 125 | 29.1 | 4.29 |
| 6S | 7.6 | 4.2 | 2.7 | 3.3 | 128 | 29.6 | 4.33 |
| 7S | 7.6 | 5.6 | 3.2 | 4.0 | 140 | 28.6 | 4.90 |
| 8S | 6.8 | 4.8 | 3.0 | 4.2 | 121 | 25.6 | 4.72 |
| 9C | 7.0 | 8.1 | 3.1 | 4.0 | 199 | 35.6 | 5.59 |
| 9S | 6.8 | 6.2 | 3.0 | 4.3 | 191 | 36.6 | 5.21 |
| 10C | 7.5 | 9.2 | 2.9 | 3.4 | 156 | 27.5 | 5.68 |
| 10S | 7.1 | 11.0 | 2.9 | 3.3 | 152 | 27.1 | 5.62 |
| 11C | 6.7 | 11.3 | 3.7 | 4.2 | 159 | 27.3 | 5.82 |
| 11 | 6.6 | 12.1 | 3.0 | 3.8 | 220 | 27.5 | 8.00 |
| 12 | 6.5 | 12.2 | 3.5 | 4.1 | 227 | 40.5 | 5.60 |
| 12S | 6.9 | 11.5 | 2.9 | 3.8 | 194 | 38.4 | 5.05 |

Example 2

Soft Creped Through-Air Dried Tissue

Additional inventive samples were made using a papermaking process commonly referred to as creped through-air-dried ("CTAD") in which the web is formed using a through-air dried tissue making process and creped after final drying.

Initially, northern softwood kraft (NSWK) pulp (Pictou Harmony Pulp, Northern Pulp, Nova Scotia, Canada) was dispersed in a pulper for 30 minutes at about 1.6 percent consistency at about 100° F. The NSWK pulp was refined in a batch refiner for about 4 minutes to a Canadian Standard Freeness (CSF) value of about 500 ml. The NSWK pulp was then transferred to a dump chest and subsequently diluted with water to approximately 0.6 percent consistency. Softwood fibers were then pumped to a machine chest where they were further diluted with water to a consistency of about 0.3 percent and mixed with 2 kg/MT of Kymene® 920A on a dry-solids basis (Ashland Water Technologies, Wilmington, Del.) and 1 kg/MT of Baystrength 3000 (Kemira, Atlanta, Ga.) prior to the headbox. The softwood fibers were added to the middle layer in the 3-layer tissue structure. The NSWK content contributed approximately 30 percent of the final sheet weight. The specific layer splits (dryer layer/middle layer/felt layer) are as set forth in Table 5.

Eucalyptus hardwood kraft (EHWK) pulp (Fibria Veracel pulp, Fibria, Sao Paulo, Brazil) was dispersed in a pulper for 30 minutes at about 2.3 percent consistency at about 100° F. The EHWK pulp was then transferred to a dump chest and diluted to about 1.0 percent consistency. The EHWK pulp was then pumped to a machine chest where they were further diluted with water to a consistency of about 0.22 percent and mixed with 2 kg/MT of Kymene® 920A. These fibers were added to the dryer and felt layers of the 3-layer sheet structure and contributed to approximately 70 percent of the final sheet weight. The specific layer splits (dryer layer/middle layer/felt layer) are as set forth in Table 5.

Debonder (ProSoft™ TQ-1003, Ashland, Inc., Covington, Ky.) was added to the machine chest supplying EHWK pulp to the dryer side of the three layered tissue structure. The amount of debonder added varied from 4 pounds per ton of fiber to 12 pounds of debonder per ton of EHWK pulp, depending on the sample (see Table 5 for details).

The pulp fibers from the machine chests were pumped to the headbox at a consistency of about 0.02 percent. Pulp fibers from each machine chest were sent through separate manifolds in the headbox to create a 3-layered tissue structure. The web was formed on a TissueForm V forming fabric (Voith Paper fabrics, Wilson, N.C.), transferred to a Voith 2164 fabric (Voith Paper fabrics, Wilson, N.C.) and vacuum dewatered to roughly 25 percent consistency. The web was then transferred to a Voith Saturn 852 fabric (Voith Paper fabrics, Wilson, N.C.) for the TAD fabric. No rush transfer was utilized at the transfer to the TAD fabric. After the web was transferred to the TAD fabric, the web was dried, however the consistency was maintained low enough to allow significant molding when the web was transferred using high vacuum to the impression fabric. A vacuum level of at least 10 inches of mercury was used for the transfer to the impression fabric in order to mold the web as much as possible into the fabric. Two different impression fabrics were used, as shown in Table 5—either a Voith Saturn 852 fabric (Voith Paper fabrics, Wilson, N.C.) with the long shute (LS) knuckles toward the sheet or a Voith Saturn 952 fabric (Voith Paper fabrics, Wilson, N.C.) with the long warp (LW) knuckles toward the sheet. The web was then transferred to a Yankee dryer and creped. Minimum pressure was used at the web transfer to minimize compaction of the web during the transfer to the Yankee dryer so as to maintain maximum web caliper.

TABLE 5

| Sample | Debonder (lb/MT) | Layer Splits (% HW/ % SW/% HW) | Refining (min) | Impression Fabric |
|---|---|---|---|---|
| 13 | 0 | 35/30/35 | 5 | Saturn 852 - LS |
| 14 | 0 | 35/30/35 | 4 | Saturn 852 - LS |
| 15 | 6 | 35/30/35 | 4 | Saturn 852 - LS |
| 16 | 0 | 35/30/35 | 4 | Saturn 852 - LS |
| 17 | 0 | 35/30/35 | 4 | Saturn 852 - LS |
| 18 | 0 | 35/30/35 | 3 | Saturn 852 - LS |
| 19 | 0 | 35/30/35 | 3 | Saturn 852 - LS |
| 20 | 0 | 35/30/35 | 3 | Saturn 852 - LS |
| 21 | 12 | 35/30/35 | 3 | Saturn 852 - LS |

TABLE 5-continued

| Sample | Debonder (lb/MT) | Layer Splits (% HW/ % SW/% HW) | Refining (min) | Impression Fabric |
|---|---|---|---|---|
| 22 | 4 | 35/30/35 | 3 | Saturn 952 - LW |
| 23 | 4 | 35/30/35 | 3 | Saturn 952 - LW |

The web was adhered to the Yankee dryer using one of the creping compositions specified in Table 6, below. The creping compositions were prepared by dissolution of the solid polymers into water followed by stirring until the solution was homogeneous. Individual polymers were diluted depending on the desired spray coverage on the Yankee dryer. Alternatively, flow rates of the polymer solutions were varied to provide the desired amount of solids to the base web. The sheet was dried to about 98 to 99 percent consistency as it traveled on the Yankee dryer and to the creping blade. The Yankee dryer was heated with 30 to 35 psi of steam to dry the sheet to a target sheet temperature of 240° F., as measured above the creping blade. The Yankee dryer was traveling at about 60 FPM, unless otherwise noted. The creping blade, an 80-Proto-HY02 Durablade® (BTG, Eclepens, Switzerland) with a 10 to 15 degree grind angle, was loaded at a pressure of 30 psig. The creping blade subsequently scraped the tissue sheet off of the Yankee dryer. The creped tissue basesheet was then wound onto a core traveling at about 47 to about 52 FPM into soft rolls for converting. The basis weight of the resulting tissue was about 14 gsm and the GMT ranged from about 300 to about 450 g/3".

TABLE 6

| Sample | Component 1 (wt %) | Component 2 (wt %) | Component 3 (wt %) | Creping composition Add-on (mg/m$^2$) | Post Treatment |
|---|---|---|---|---|---|
| 13C | PVOH (91.7%) | Kymene 920A (7.6%) | Rezesol 2008M (0.7%) | 40 | Calendered |
| 14C | PVOH (91.7%) | Kymene 920A (7.6%) | Rezesol 2008M (0.7%) | 40 | Calendered |
| 14S | PVOH (91.7%) | Kymene 920A (7.6%) | Rezesol 2008M (0.7%) | 40 | Silicone |
| 15C | PVOH (91.7%) | Kymene 920A (7.6%) | Rezesol 2008M (0.7%) | 40 | Calendered |
| 16C | PVOH (91.7%) | Kymene 920A (7.6%) | Rezesol 2008M (0.7%) | 60 | Calendered |
| 17C | Redibond 2038A (40%) | PC1279 (40%) | TQ-1003 (20%) | 300 | Calendered |
| 17S | Redibond 2038A (40%) | PC1279 (40%) | TQ-1003 (20%) | 300 | Silicone |
| 18C | Redibond 2038A (40%) | PC1279 (40%) | TQ-1003 (20%) | 300 | Calendered |
| 19C | Redibond 2038A (40%) | PC1279 (40%) | TQ-1003 (20%) | 300 | Calendered |
| 20C | PVOH (80%) | N80 Polyox (20%) | — | 200 | Calendered |
| 20S | PVOH (80%) | N80 Polyox (20%) | — | 200 | Silicone |
| 21C | PVOH (80%) | N80 Polyox (20%) | — | 200 | Calendered |
| 21S | PVOH (80%) | N80 Polyox (20%) | — | 200 | Silicone |
| 22C | PVOH (91.7%) | Kymene 920A (7.6%) | Rezesol 2008M (0.7%) | 40 | Calendered |
| 23C | PVOH (80%) | N80 Polyox (20%) | — | 200 | Calendered |

The soft rolls were then either converted directly to tissue product by rewinding and plying so that both creped sides were on the outside of a 2-ply tissue product, or subject to post treatment. In the event that soft rolls were post treated, they were either calendered or treated with silicone (see Tables 3 and 4 for details). The calendering was between two steel rolls with a nip loading of 50 psi. Silicone treatment was done by applying 1 percent (bone dry weight) of Momentive Y-14868 silicone emulsion (commercially available from Momentive Performance Materials, Albany, N.Y.) using rotogravure printing on the outside surface of each of the two plies.

TABLE 7

| Sample | GMT (g/3") | TS7 | TS750 | E (mm/N) | D (mm/N) |
|---|---|---|---|---|---|
| 13C | 894 | 5.7 | 6.5 | 2.71 | 3.07 |
| 14C | 735 | 5.3 | 5.7 | 2.74 | 3.10 |
| 14S | 735 | 5.2 | 5.6 | 2.98 | 3.38 |
| 15C | 651 | 4.1 | 5.3 | 2.68 | 3.36 |
| 16C | 777 | 6.2 | 6.7 | 2.31 | 2.75 |
| 17C | 851 | 4.9 | 6.4 | 2.25 | 2.61 |
| 17S | 851 | 5.4 | 5.7 | 2.43 | 2.87 |
| 18C | 916 | 4.6 | 5.7 | 2.18 | 2.71 |
| 19C | 936 | 5.9 | 5.9 | 2.15 | 2.48 |
| 20C | 999 | 6.4 | 6.3 | 2.02 | 2.35 |
| 20S | 999 | 5.4 | 5.5 | 2.21 | 2.54 |
| 21C | 530 | 4.4 | 5.7 | 2.31 | 2.88 |
| 21S | 530 | 4.3 | 5.5 | 2.62 | 3.31 |
| 22C | 680 | 6.6 | 6.4 | 2.42 | 2.76 |
| 23C | 587 | 6.0 | 5.3 | 2.65 | 3.08 |

These and other modifications and variations to the present invention may be practiced by those of ordinary skill in the art. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

We claim:

1. A creped multi-ply tissue product comprising at least one creped tissue ply having a first and a second side, wherein a water-soluble creping composition selected from the group consisting of a polyether, a polyamide, a polyvinyl alcohol, a cationic starch, and a cationic polyamide-epihalohydrin and combinations thereof, is disposed on at least the first or the second side the tissue product having a basis weight of at least about 20 gsm, a GMT of at least about 600 g/3", and a TS7 value from about 4.0 to about 8.0 dB V2 rms.

2. The creped multi-ply tissue product of claim 1 wherein the product has a GMT from about 600 g/3" to about 1,000 g/3" and a TS750 value less than about 7.0 dB V2 rms.

3. A multi-ply tissue product comprising at least one creped tissue web prepared by wet forming a fibrous web, applying a creping composition consisting essentially of a polyvinyl alcohol and a second component selected from the group consisting of a polyether, a polyamide, a water soluble cationic polymer, carboxymethyl cellulose, hydroxymethyl cellulose and hydroxypropyl cellulose to a dryer surface, transferring the fibrous web to the dryer surface and creping the fibrous web to remove the web from the dryer surface, the tissue product having a TS7value from about 4.0 to about 8.0 d $V^2$ rms and a GMT of at least about 600 g/3".

4. The multi-ply tissue product of claim 3 wherein the water soluble cationic polymer is a cationic starch, a tertiary aminoalkyl ether, a quaternary ammonium alkyl ether, a cationic polyamide-ephihalohydrin or a quaternary ammonium salt having the general formula: $(R^{1'})_{4-b}-N^{+}-(R^{1''})_b\ X^{-}$ wherein $R^{1'}$ is a $C_{1-6}$ alkyl group, $R^{1''}$ is a $C_{14-22}$ alkyl group, b is an integer from 1 to 3 and $X^{-}$ is any suitable counterion.

5. The multi-ply tissue product of claim 3 wherein the fibrous web comprises a first and a second layer, the first layer comprising hardwood kraft fibers and the second layer comprising softwood kraft fibers.

6. The multi-ply tissue product of claim 3 further comprising the step of calendering the creped fibrous web.

7. The multi-ply tissue product of claim 3 further comprising the step of treating the creped fibrous web with a polysiloxane.

8. The multi-ply tissue product of claim 3 further comprising the step of treating the creped fibrous web with a mineral oil, aloe extract, vitamin-E or a lotion.

9. The multi-ply tissue product of claim 3 wherein the GMT is from about 600 to about 1,000 g/3" and a basis weight greater than about 25 gsm.

10. The multi-ply tissue product of claim 3 wherein the tissue product has a TS750from about 4.0 to about 6.0 d $V^2$ rms.

11. A multi-ply tissue product comprising at least one creped tissue web prepared by wet forming a fibrous web, applying a creping composition consisting essentially of two or more components selected from the group consisting of polyethers, polyamides, polyvinyl alcohol, carboxymethyl cellulose, hydroxymethyl cellulose, hydroxypropyl cellulose, and water soluble cationic polymers to a dryer surface, transferring the fibrous web to the dryer surface comprising the water soluble creping composition and creping the fibrous web to remove the web from the dryer surface, the tissue product having a TS7 value from about 4.0 to about 8.0 d $V^2$ rms and a GMT of at least about 600 g/3".

12. The multi-ply tissue product of claim 11 wherein the water soluble cationic polymer is selected from the group consisting of cationic starch, tertiary aminoalkyl ethers, quaternary ammonium alkyl ethers, cationic polyamide-ephihalohydrin, and quaternary ammonium salts having the general formula: $(R^{1'})_{4-b}\ -N^{+}-(R^{1''})_b\ X^{-}$ wherein $R^{1'}$ is a $C_{1-6}$ alkyl group, $R^{1''}$ is a $C_{14-22}$ alkyl group, b is an integer from 1 to 3 and $X^{-}$ is any suitable counterion.

13. The multi-ply tissue product of claim 11 further comprising the step of calendering the creped fibrous web.

14. The multi-ply tissue product of claim 11 further comprising the step of treating the creped fibrous web with a polysiloxane.

15. The multi-ply tissue product of claim 11 further comprising the step of treating the creped fibrous web with a mineral oil, aloe extract, vitamin-E or a lotion.

16. The multi-ply tissue product of claim 11 wherein the GMT is from about 600 to about 1,000 g/3" and a basis weight greater than about 25 gsm.

* * * * *